US006824498B2

(12) United States Patent
Hassler

(10) Patent No.: US 6,824,498 B2
(45) Date of Patent: Nov. 30, 2004

(54) THERAPEUTIC AND TRAINING DEVICE FOR THE SHOULDER JOINT

(75) Inventor: Andreas Hassler, Rohrdorf (DE)

(73) Assignee: OPED AG, Steinhausen (CH)

( * ) Notice: Subject to any disclaimer, the term of this patent is extended or adjusted under 35 U.S.C. 154(b) by 0 days.

(21) Appl. No.: 10/466,334

(22) PCT Filed: Dec. 6, 2001

(86) PCT No.: PCT/EP01/14339

§ 371 (c)(1),
(2), (4) Date: Jul. 11, 2003

(87) PCT Pub. No.: WO02/055006

PCT Pub. Date: Jul. 18, 2002

(65) Prior Publication Data

US 2004/0067832 A1 Apr. 8, 2004

(30) Foreign Application Priority Data

Jan. 11, 2001 (DE) ..... 101 01 214

(51) Int. Cl.[7] ..... A63B 21/00
(52) U.S. Cl. ..... 482/1; 482/126; 601/33
(58) Field of Search ..... 482/91, 92, 121, 482/126–131, 908; 601/23, 33

(56) References Cited

U.S. PATENT DOCUMENTS

| | | | | |
|---|---|---|---|---|
| 4,971,040 A | | 11/1990 | Gillotti | |
| 5,080,350 A | | 1/1992 | Schofield et al. | |
| 5,580,341 A | * | 12/1996 | Simonson | 482/100 |
| 5,613,928 A | * | 3/1997 | Laudone | 482/139 |
| 5,755,646 A | | 5/1998 | Chu | |
| 6,004,247 A | * | 12/1999 | Webber | 482/100 |

* cited by examiner

*Primary Examiner*—Glenn E. Richman
(74) *Attorney, Agent, or Firm*—McGlew and Tuttle, P.C.

(57) ABSTRACT

The invention relates to a therapy and training device for the shoulder joint (43) with a trunk base (21), having a rotational joint base (22) two shoulder extensions (27), respectively associated with a shoulder, rotational around a vertical axis of a shoulder rotational joint means, having an arm extension, respectively spaced apart from the rotational joint base for connection with an arm (42, 48), which is rotationally connected with the shoulder extension (27) around a transverse axis (37) by an upper arm rotational joint means (30), wherein said shoulder extension and/or said arm extension are coupled in movement such that a rotational movement of one shoulder extension, or respectively, one arm extension, causes a rotational movement of the other shoulder extension, or respectively, the other arm extension.

23 Claims, 7 Drawing Sheets

THERAPEUTIC AND TRAINING DEVICE FOR THE SHOULDER JOINT

FIELD OF THE INVENTION

The present invention relates to a therapy and training device for the shoulder joint with a trunk base having two shoulder extensions on a rotational joint base, respectively associated with a shoulder, rotational around a vertical axis of a rotational shoulder joint means, having respectively spaced apart from the rotational joint base an arm extension for connection with an arm, which is rotationally connected with the shoulder extension around a transverse axis by an upper arm rotational joint means, wherein the shoulder extensions and/or the arm extension are coupled together for movement such that a rotational movement of one shoulder extension, or respectively, of an arm extension causes a rotational movement of the other shoulder extension, or respectively, of the other arm extension.

BACKGROUND OF THE INVENTION

Therapy and training devices utilized for the treatment of movement constraints in an extremity and based on the principle that through the movement of the healthy extremity a movement of the extremity restricted in its mobility is induced, have so far been used for therapy and mobility training of knee joint. Such a therapy and training device is, for example, known from DE 195 09 465 A1. The known therapy and training device serves to treat movement constraints on a knee joint and, due to the substantially single-axis joint form of the knee joint, is relatively simply equipped with only a rotational joint means which connects a lower leg receptacle and an upper leg receptacle as a joint, wherein in therapy operation ideally the rotational axis of the rotational joint means corresponds with the knee joint axis of the patient.

Whereas in practice there is a particularly great need for rehabilitation with regard to movement constraints on the knee joint due to the frequency of knee injuries and associated knee operations, movement constraints on joints, however, generally are always ascertained when a prolonged immobilization of the joint was necessary after a surgical procedure. This also applies in particular with shoulder injuries or surgical procedures on the shoulder which can lead to considerable restrictions in movement in the shoulder region. Based on the complexity of the joint situation in the shoulder area, it is not possible, however, to use the known therapy and training device for a corresponding therapy of a shoulder joint.

SUMMARY OF THE INVENTION

From FR-A-1257 091 a therapy and training device for the shoulder joint is known, having a trunk base, which has on a rotational joint base two shoulder extensions, respectively associated with a shoulder, rotationally coupled by means of a rotational joint means. The shoulder extensions, respectively spaced apart from the rotational joint base, are provided with an arm extension, which is rotationally connected with the shoulder extension around a transverse axis by a upper arm rotational joint means. The arm extensions are coupled in movement such that a rotational movement of an arm extension causes a rotational movement of the other arm extension.

From FR-A-2 789 304 a device is known for the passive mobilization of the upper limbs with different motor means for the prompting of movement drive of a patient's arm.

U.S. Pat. No. 5,613,928 shows a training device with two arm handles coupled in movement for muscle training.

From U.S. Pat. No. 4,971,040 a portable massage chair is known for performing massage therapy in any location.

The object of the present invention is to propose a therapy and training device that enables the performance of a complex movement treatment for the shoulder joint.

This object is achieved by therapy and training device exhibiting the features of claim 1.

In the therapy and training device according to the invention, the rotational joint means is formed as a rotational shoulder joint means such that the shoulder extensions are rotational around a vertical axis of the rotational shoulder joint means and are coupled in movement such that a rotational movement of the one shoulder extension causes a rotational movement of the other shoulder movement.

The configuration of the therapy and training device according to the invention particularly takes into account the shoulder anatomy, leading to the fact that shoulder movements, as a rule, induce arm or at least upper arm movements and vice versa. For example, already a simple forward and backward movement of a shoulder is combined with even a slight rotational movement of the upper arm. Such complex interrelationships of movement require a corresponding joint configuration on the therapy and training device. For the forward and backward movement, thus, the formation of a vertical axis on the therapy and training device is necessary which is arranged preferably adjacent to the shoulder base. In order to enable the overlapping rotational movement of the upper arm with the forward and backward movement, the formation of a rotating axis running correspondingly transverse to the vertical axis is required, which enables a so-called ante- and retro-version of the arm, therefore a forward and backward swinging.

The forward and backward movement of the shoulder blade with the overlapping forward and backward movement of the arm is enabled by the shoulder extension, formed as a joint lever, enabling a connection between the shoulder rotational joint means and the upper arm rotational joint means, thus, between the vertical axis and the transverse axis. To transmit the rotational movement executed on one side of the body by the shoulder blade or the arm or both to the other side of the body, the shoulder extension respectively associated with the other side of the body, or respectively, the arm extension associated with the other side of the body is respectively coupled in movement with its corresponding counterpart.

Particularly for the repositioning of the therapy and training device relative to the upper body of the patient, it is advantageous when a positioning means for the relative positioning vis-a-vis the spinal column of the patient is associated with the rotational joint base. Through this, it is possible to position the therapy and training device to the upper body of the patient without requiring an adjustment of the joint configuration of the therapy and training device to the individual anatomy of the patient even after an interruption of therapy and for the resumption of therapy.

A particularly direct manner of positioning results when the positioning means has a neck receptacle, adjustable in height, arranged on the rotational joint base along the trunk base. The neck receptacle, furthermore, also provides a possibility to prevent voluntary or involuntary avoidance movements of the upper body during the operation of the therapy and training device which could negatively affect, in particular, the desired adjustment of the joint configuration of the to therapy and training device to the individual anatomy of the patient. In principle, of course, other correspondingly effective means can be provided.

When the arm extension on the therapy and training device comprises an upper arm extension and a lower arm extension, wherein the upper arm extension is connected to the shoulder extension via the upper arm rotational joint means and the lower arm extension via an elbow joint means comprising at least a rotational axis is connected to the upper arm extension, it is possible to also integrate lower arm movements. For this purpose, relative movements in the simplest form of the lower arm compared to the upper area are sufficient, without having to transmit the movements of the lower arm extension like the movements of the upper arm extension and of the shoulder extension on the other side of the body in movement-coupled manner. Since relative movements of the lower arm can often be performed without restrictions compared to the upper arm with a shoulder restricted in movement, a corresponding coupling of the movement of the lower arm extensions of both sides can be omitted. Since, on the other hand, however, changed relative positions of the lower arm compared to the upper arm due to the associated displacement of mass can very well affect movements of the shoulder, the relative mobility of the lower arm extension can positively affect the success of therapy.

In addition, when the elbow joint means has two rotational axes, wherein a vertical axis runs transverse to the longitudinal extension of the upper arm extension and a transverse axis runs in the direction of the longitudinal extension of the upper arm extension, a coaxial joint means is formed which substantially corresponds to the actual anatomical proportions on the elbow joint.

Further, when the connection of the arm extension with an arm takes place by means of a connecting means arranged on the lower arm extension, e.g. longitudinal rotations of the upper arm compared to the upper arm extension are readily possible. For that reason, for example, it can be dispensed with forming the upper arm rotational joint means such that also longitudinal rotations of the upper arm extension are possible.

In a particularly advantageous embodiment of the therapy and training device at least one lower arm extension is provided with an actuating means to trigger a locking device operative on the upper arm rotational joint means, wherein an actuation of the actuating means results when the associated lower arm is released from its connection with the lower arm extension. Through this, a kind of "emergency switch" is realized which prevents that movements are performed by the unsound shoulder which are not performed by the sound extremity of the opposite side, or respectively, the sound shoulder, so that, for example, the unsound arm after a release of the connection of the lower arm of the sound side with the lower arm extension cannot fall down as a result of gravity from an elevated position.

A possible embodiment of such an "emergency switch" can, for example, consist of a control knob provided with a switch is provided at the free end of the lower leg receptacle, in which the switch is actuated by a release of the handle.

If the upper arm extension can be adjusted in its operative length between the upper arm rotational joint means and the elbow joint means, it is possible to compensate deviations between the rotational axis of the upper arm rotational joint means and the actual rotational axis of the shoulder joint by appropriate adjustments in length, without having constraints in movement arise.

A particularly effective therapy for the rehabilitation of movement restrictions on an affected shoulder joint is possible, when for coupled movement at least the shoulder rotational joint means and the upper arm rotational joint means of a side of the body are coupled with respectively the shoulder rotational joint means and the upper arm rotational joint means of the other side of the body by means of a coupling means, such that a joint movement on one side of the body causes a defined joint movement of the corresponding joint means on the other side of the body. According to the form of the corresponding coupling means, the induced counter movement takes place conversely, inversely or also in a defined geared transmission or reduction ratio.

In order to be able to prevent, for example, undesired or even harmful movements, the joint means provided on the therapy and training device can be provided at least partially with means to restrict joint movements.

In a further possible embodiment, the coupling means for coupled movement of the shoulder rotational joint means is formed as a wheel gear, wherein the wheel gear can be formed as a friction gear or as a gearwheel.

In a further preferable embodiment, the coupling means for the coupled movement of the upper arm rotational joint means is formed as a traction mechanism or a pressure gear so that a transfer of force can ensue by cable or by hydraulic fluid.

A preferable modular form of the therapy and training device enabling an easy adjustment to the given proportions is given if the trunk base has a connecting means for connection with a seat frame or a seat in general.

The trunk base can also be provided with a seat so that a use of the therapy and training device is possible independent from any further local requirements.

It is particularly advantageous when the seat frame is arranged to open out on the trunk base.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
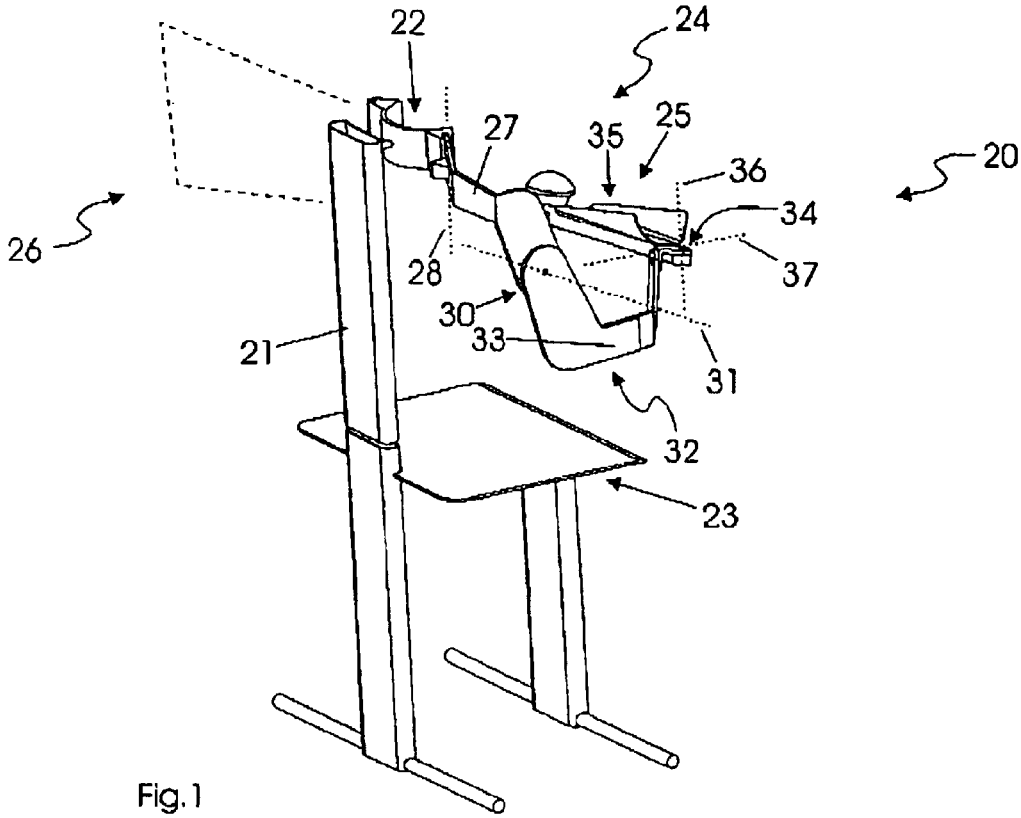
FIG. 1 is a perspective view of an embodiment of a therapy and training device for the shoulder joint in neutral position with seat frame ready for use.

Referring to the drawings in particular FIG. 1 shows a therapy and training device 20, which hereinafter will be shortened to therapy device, with a trunk base 21, a rotational joint base 22 arranged on the trunk base 21 and a seat frame 23 also arranged on the trunk base.

The rotational joint base 22 serves to couple a shoulder/arm joint system 24, comprising two shoulder/arm joint units 25, 26 formed symmetrically to the rotational joint base 22, or respectively, to the trunk base 21, of which in the following only the right shoulder/arm joint unit 25 is illustrated in detail. The shoulder/arm joint unit 25 comprises as in the shoulder/arm joint unit 26 not illustrated in detail, a shoulder extension 27, rotational around a vertical axis 28 by means of a rotational shoulder joint means 29 coupled to the rotational joint base 22. The shoulder extension 27 formed in the present case cranked downward is provided with an upper arm rotational joint means 30 on its distal end, such that an arm extension 32 is coupled on the shoulder extension 27 to be rotational around a transverse axis 31.

The arm extension 32 has an upper arm extension 33 directly connected with the upper arm rotational joint means 30 and a lower arm extension 35, attached by an articulated elbow joint means 34. The elbow joint means 34 enables a relative swinging of the lower arm extension 35 compared to the upper arm extension 33 around a vertical axis 36 and a transverse axis 37 running substantially in the direction of the longitudinal extension of the upper arm extension 33.

Figure 2:
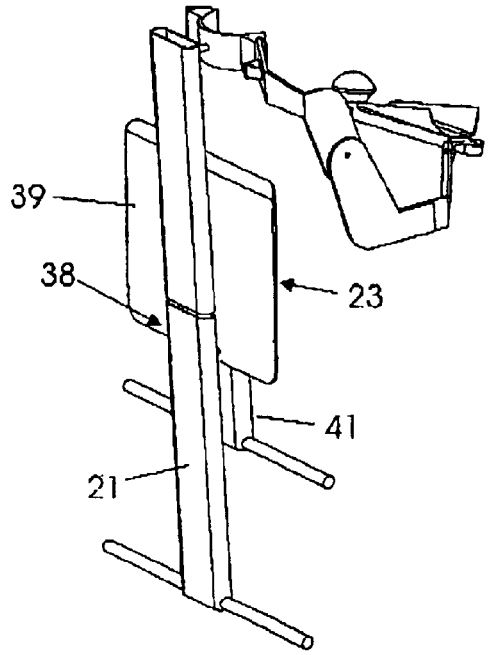
FIG. 2 shows the therapy and training device according to FIG. 1 with folded seat frame.

As can be seen clearly from a joint viewing of FIGS. 1 and 2, the seat frame 23 is attached by a hinge joint 38 to the trunk base 21 as a folding frame with a seat board 39 that can be folded up against the trunk base 21 and with a supporting leg 41 connected to the seat board 39 by a hinge joint not shown in detail.

To illustrate the proportions and a relative arrangement of the individual parts forming the shoulder/arm joint system 24, or respectively, the shoulder/arm joint unit 25, a human figure in seated position is shown schematically in FIG. 3 with extremities on the right-hand side indicated, wherein a lower arm 42 is situated in a position connected with the lower arm extension 35, the right shoulder 43 is situated below the shoulder extension 27 and an upper arm 48 extends on the inner side of the upper arm extension 33 from the upper arm rotational joint means 30 to the elbow joint means 34.

Figure 3:
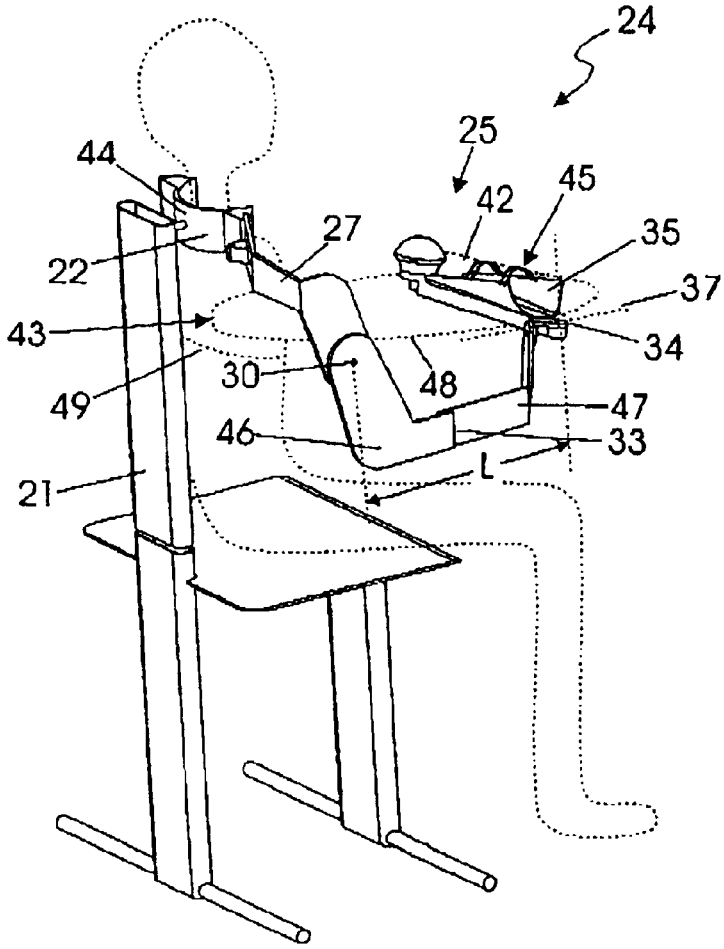
FIG. 3 shows the therapy and training device with an extended upper arm extension in contrast to the illustration in FIG. 1.

FIG. 3 further illustrates that a relative positioning of the human body to the therapy and training device 20 occurs via a positioning means formed as a neck receptacle 44 in the present case, which is an integral part of the rotational joint base 22. The force transmission for the transmission of movement from the shoulder/arm region on the therapy and training device, or respectively, the shoulder/arm joint system 24 and vice verse occurs via the connection of the lower arm 42 with the lower arm extension 35 by means of a connecting means 45. Moreover, a comparison of FIGS. 3 and 1 illustrates clearly that an adjustment of the shoulder/arm joint system 24, or respectively, the shoulder/arm joint unit 25 to the upper body extremities can ensue by a change of the effective length L of the upper arm extension 33, which consists for this purpose of two parts adjustable in the longitudinal direction relative to each other, namely an upper part 46 and a lower part 47. An adjustment of the length of the shoulder extension 27 to the individual body proportions is generally not necessary, but can of course also be provided.

Starting from the configuration illustrated in FIGS. 1 and 3 defined here as the neutral position of the shoulder/arm joint unit 25, the therapy device 20 in the present embodiment form enables the relative positions or movements illustrated in the following FIGS. 4 to 11.

Figure 4:
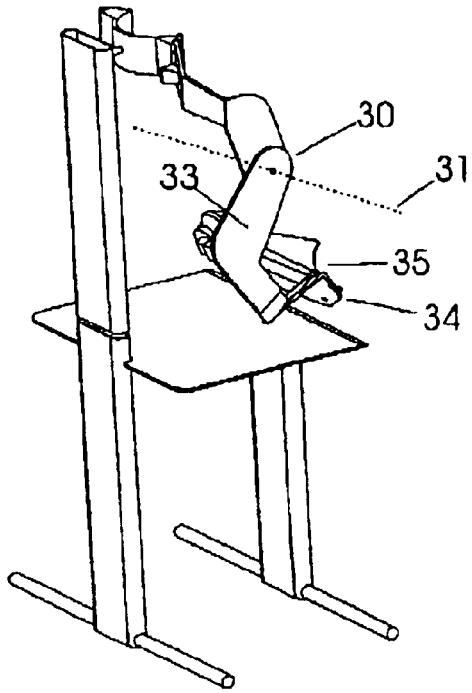
FIG. 4 shows the therapy and training device with upper arm extension rotated downwards around the transverse axis.
Figure 5:
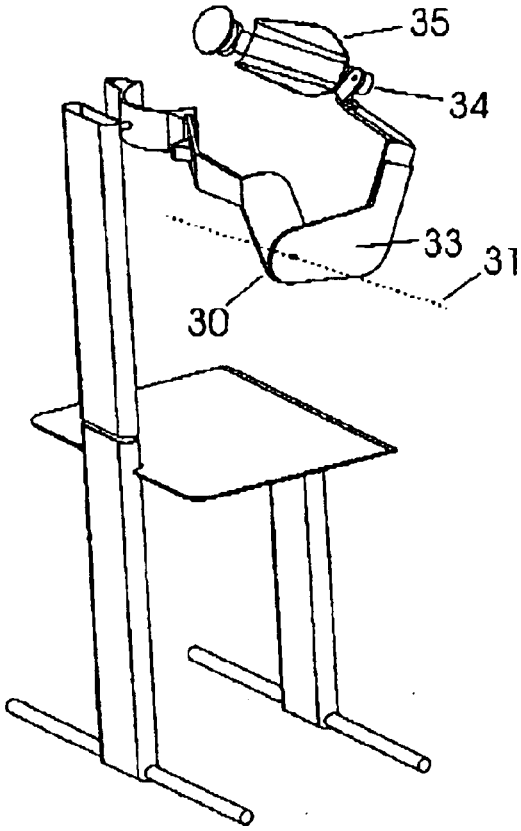
FIG. 5 shows the therapy and training device with upper arm extension rotated upwards around the transverse axis.

FIGS. 4 and 5 illustrate the possibility of performing with the lower arm 42 (FIG. 3) connected with the lower arm extension 35 by the connecting means 45 (FIG. 3) a forward and backward movement of the entire arm with the lower arm 42 (FIG. 3) bent relative to the upper arm 48. In this configuration, in order to set a defined angle of the crook of the arm, the lower arm extension 35 can be fixed opposite the upper arm extension 33 by tightening the elbow joint means 34. The upper arm joint rotational means 30 enables a rotating around the transverse axis 31. This forward and backward movement of the upper arm. 48 effects a corresponding movement of a shoulder blade 49.

Figure 12:
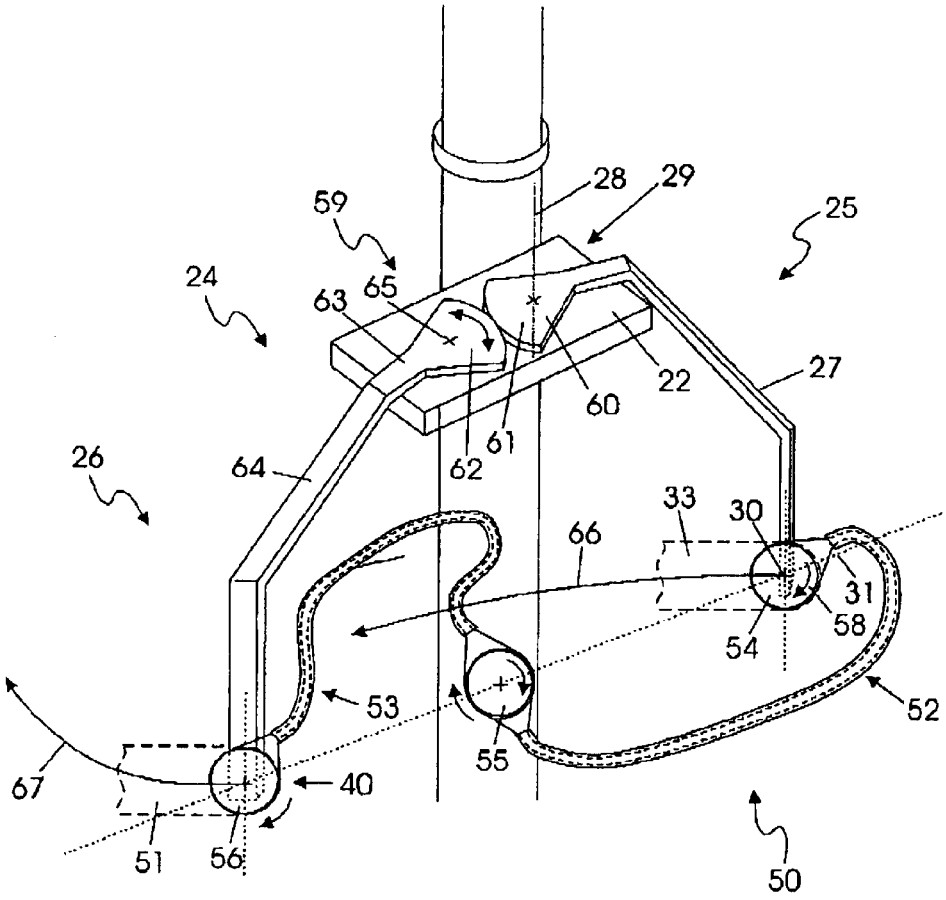
FIG. 12 is a schematic illustration of a first coupling means for coupled movement of both shoulder extensions and a second coupling means for coupled movement of both upper arm extensions of the therapy and training device.

FIG. 12 shows a coupling means 50, which enables a transmission of the forward and backward movement carried out with the right extremity, thus here with the upper arm 48, by means of the shoulder/arm joint system 24 on the left upper body extremity not shown in FIG. 3, thereby also enabling an induction of movement in the left shoulder. Hereunto the coupling means 50 acts between the upper arm extension 33 of the right shoulder/arm joint unit 25 illustrated in FIG. 3 and an upper arm extension 51 of the left shoulder/arm joint unit 26 associated with the left upper body extremity. As shown in FIG. 12, the coupling means 50 comprises two force transmission means executed as reversing cable systems 52, 53. The reversing cable system 52 acts between two cable rolls 54, 55, which are arranged non-rotational on the transverse axis 31 of the upper arm rotational joint means 30 with the upper arm extension 33 or rotational on trunk base 21. The cable roll 55 is formed as a dual cable roll and is via the reversing cable system 53 in friction-locked engagement with a further cable roll 56, which analogous to the cable roll 54 on the transverse axis 31 of the upper arm rotational joint means 40 of the left shoulder/arm joint unit 26 is non-rotationally engaged with an upper arm extension 57. By means of the coupling means 50, thus, an ensuing rotational movement of the upper arm extension 33 is transmitted in the direction of an arrow 58 via the reversing cable system 52 onto the cable roll 55 and from the cable roll 55 via the reversing cable system 53 onto the cable roll 56, non-rotationally engaged with the upper arm extension 57. In the present case, thus, through a rotational movement of the right upper arm a converse rotational movement of the left upper arm is induced. The induction of a converse rotational movement is simply possible, for example, by means of a crossed cable arrangement of one of the two reversing cable systems 52, 53.

Figure 6:
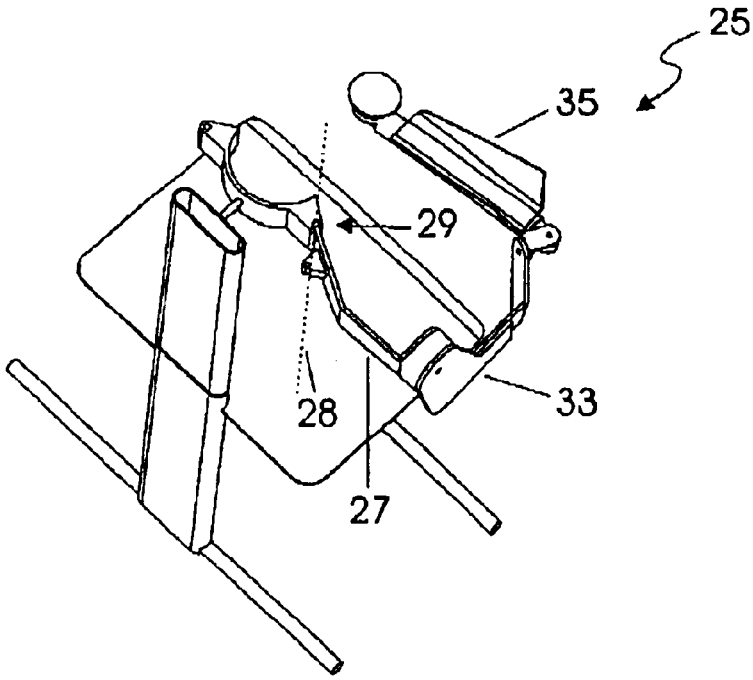
FIG. 6 shows in plan view the therapy and training device in neutral position.
Figure 7:
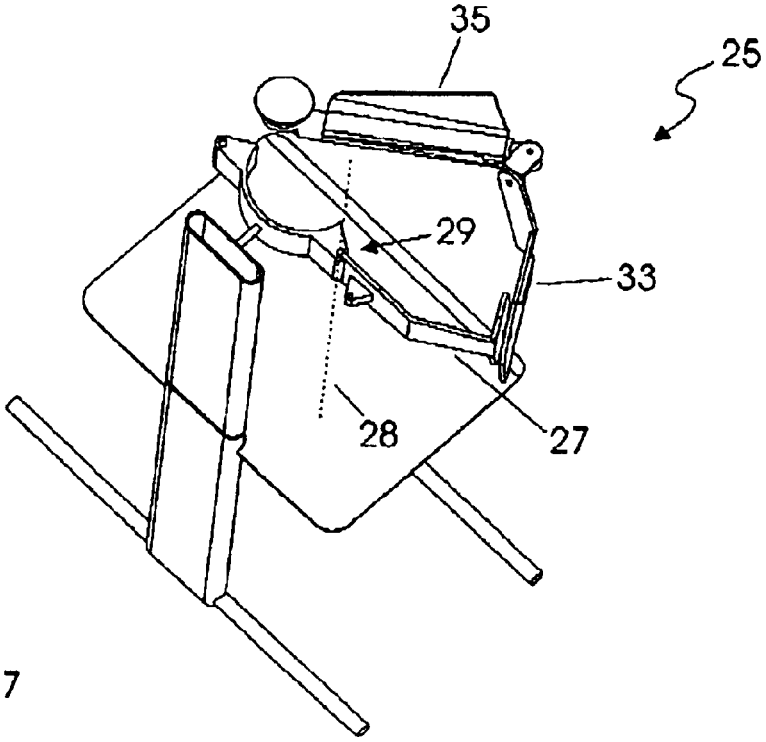
FIG. 7 shows the therapy and training device with shoulder extension 5 rotated inward around a vertical axis.
Figure 8:
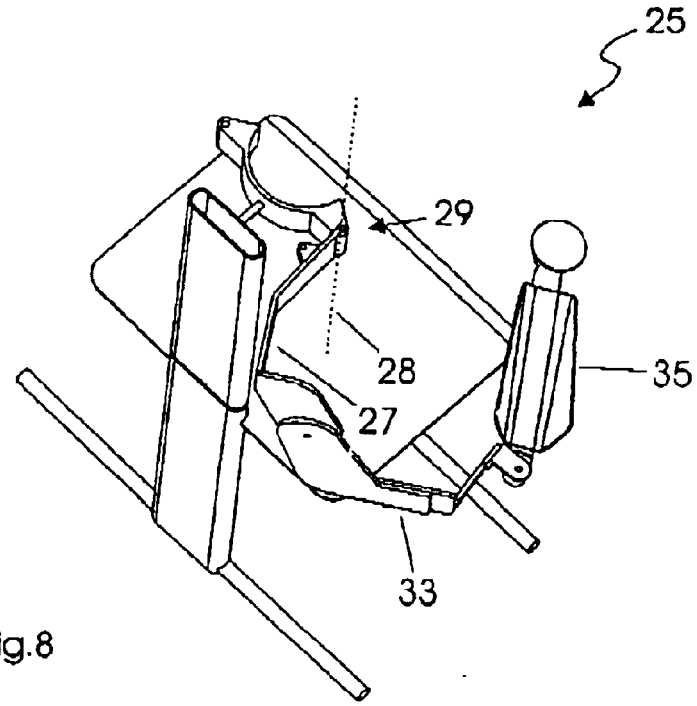
FIG. 8 shows the therapy and training device with shoulder extension rotated outward around a vertical axis.

In FIGS. 6 to 8, a forward and backward movement of the shoulder extension 27 is illustrated with the fixed lower arm extension 35 in its bent position relative to the upper arm extension arm 33. Here a rotation of the shoulder extension 27 takes place around the vertical axis 28 of the shoulder rotational joint means 29. For the transmission of this rotational movement starting from the right shoulder/arm joint unit 25 to the left shoulder/arm joint unit 26 (FIG. 1) not shown in detail in FIGS. 6 to 8, a coupling means 59 illustrated in FIG. 12 can be used. For the transmission of the rotational movement of the right shoulder extension to 27, which is rotationally coupled in the shoulder rotational joint means 29 around the vertical axis 28 on the rotational joint base 22, a bearing end 60 of the shoulder extension 27 is provided with a gearwheel segment 61 which is in engagement with a further gearwheel segment 62 which is formed on a bearing end 63 of a shoulder extension 64 of the left shoulder/arm joint 26. Analogous to the bearing end 60, the bearing end 63 of the shoulder extension 64 is supported in a shoulder rotational joint means 65 of the rotational joint base 22.

The coupling means 59 enables thus the transmission of a rotational movement 66 from the right shoulder extension 27 to the left shoulder extension 64 so that starting from a movement of the right shoulder via the coupling means 59, a corresponding rotational movement 67 of the left shoulder can be induced.

Figure 9:
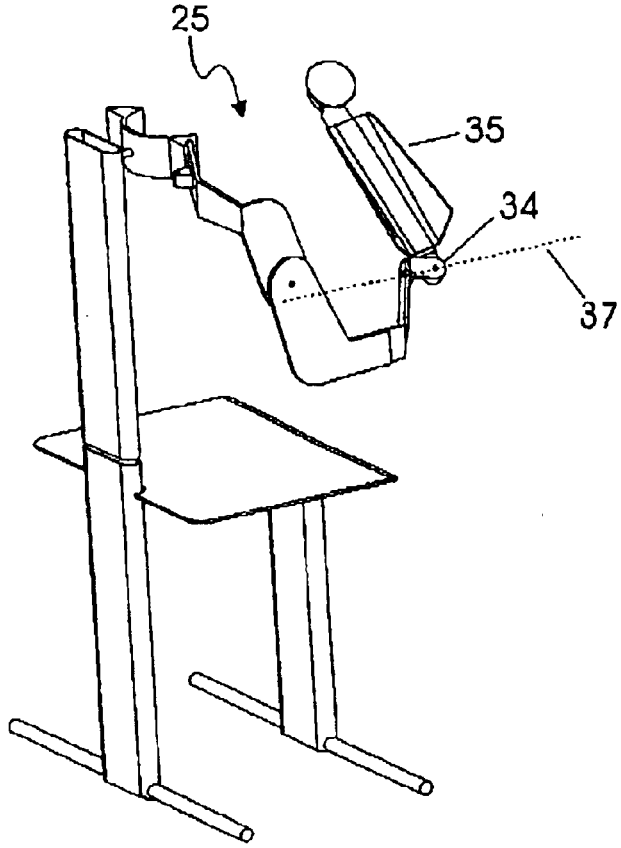
FIG. 9 shows the therapy and training device with lower arm extension rotated upward around a transverse axis.
Figure 10:
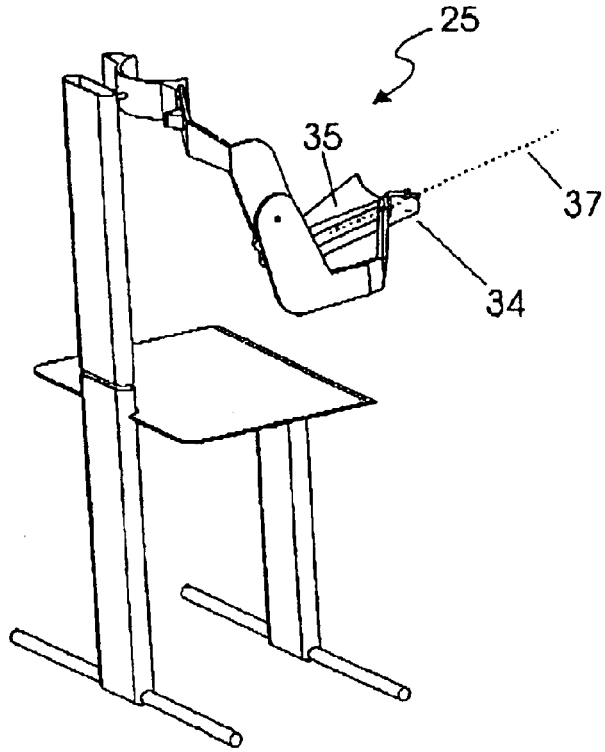
FIG. 10 shows the therapy and training device with lower arm extension rotated downward around a transverse axis.
Figure 11:
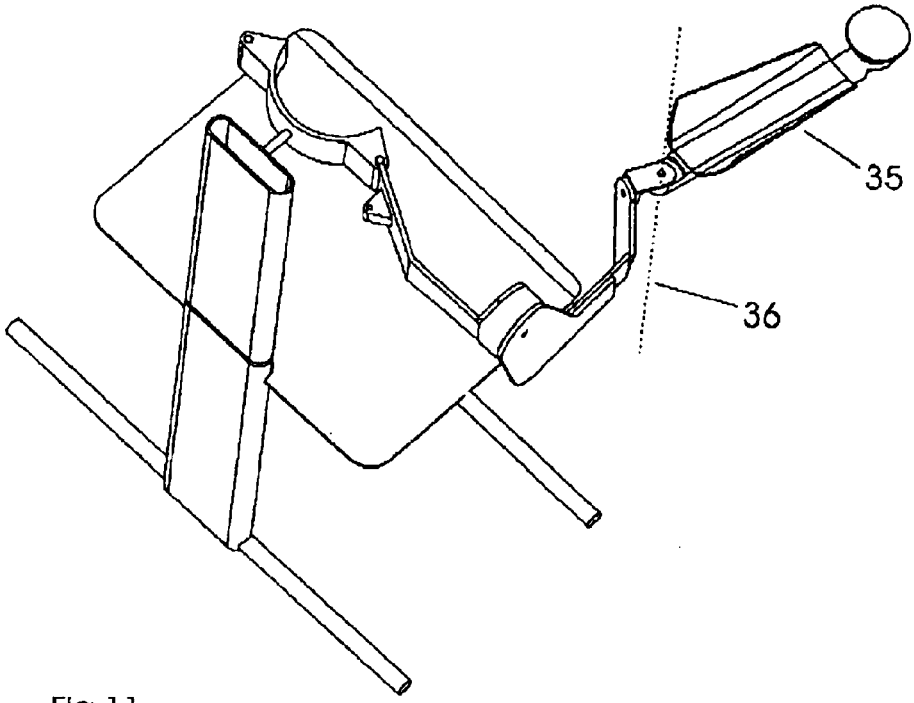
FIG. 11 shows the therapy and training device with lower arm extension rotated outward around a vertical axis.

FIGS. 9 and 10 illustrate the rotatability of the lower arm extension 35 around the transverse axis 37 of the elbow joint means 34. This rotational movement can be transmitted by means of a coupling means not shown in detail here from the right shoulder/arm joint unit 25 to the left shoulder/area joint unit 26 not illustrated in FIG. 9. Already a movement-decoupled rotatability of the lower arm extension 35 of the shoulder/arm units 25, 26 affords advantages in the operation of the therapy device 20 since the rotatability of the lower arm extension 35 around the transverse axis 37 of the elbow joint means 34 as well as a rotatability of the lower arm extension around the vertical axis 36 (FIG. 11) of the elbow joint means 34 enables the patient to freely chose a comfortable relative position of the lower arms compared to the upper arms.

While specific embodiments of the invention have been shown and described in detail to illustrate the application of the principles of the invention, it will be understood that the invention may be embodied otherwise without departing from such principles.

What is claimed is:

1. A therapy and training device for the shoulder joint with a trunk body comprising on a rotational joint base two shoulder extensions respectively associated with a shoulder, coupled rotationally by means of a shoulder rotational joint means, respectively having an arm extension spaced apart from the rotational joint base for connection with an arm, which is rotationally connected with the shoulder extension around a transverse axis by an upper arm rotational joint means, wherein the arm extensions are coupled in movement such that a rotational movement of one arm extension causes a rotational movement of the other arm extension, wherein the rotational joint means is formed as a rotational shoulder joint means such that the shoulder extensions are rotational around a vertical axis of the rotational shoulder joint means and coupled in movement such that a rotational movement of one shoulder extension causes a rotational movement of the other shoulder extension.

2. The therapy and training device according to claim 1, wherein the rotational joint base has a positioning means associated thereto for the relative positioning vis-a-vis the spinal column of a patient.

3. The therapy and training device according to claim 2, wherein the positioning means has a neck receptacle along the trunk base adjustable in height and arranged on the rotational joint base.

4. The therapy and training device according to claim 1, wherein the arm extension comprises an upper arm extension and a lower arm extension, wherein the upper arm extension is connected with the shoulder extension by the upper arm rotational joint means, and the lower arm extension is connected with the upper arm extension by an elbow joint means comprising at least one rotational axis.

5. The therapy and training device according to claim 4, wherein the elbow joint means has two rotational axes, wherein a vertical axis runs transverse to the longitudinal extension of the upper arm extension and a transverse axis in the direction of the longitudinal extension of the upper arm extension.

6. The therapy and training device according to claim 4, wherein a connection means is provided on the lower arm extension for connection of the arm extension with an arm.

7. The therapy and training device according to claim 4, wherein at least one lower arm extension is provided with an actuating means to trigger a locking means operative on the upper arm rotational joint means, wherein an actuation of the actuating means ensues when the associated lower arm is released from its connection with the lower arm extension.

8. The therapy and training device according to claim 4, wherein the upper arm extension is adjustable in its effective length between the upper arm rotational joint means and the elbow joint means.

9. The therapy and training device according to claim 1, wherein for the coupling of movement at least the shoulder rotational joint means and the upper arm rotational joint means of one side of the body are coupled with respectively the shoulder rotational joint means and the upper arm rotational joint means of the other side of the body by means of a coupling means such that a joint movement of one side of the body effects a defined joint movement of the corresponding joint means on the other side of the body.

10. The therapy and training device according to claim 9, wherein the coupling means for a coupling movement of the shoulder rotational joint means is formed as a wheel gear.

11. The therapy and training device according to claim 9, wherein the coupling means for the coupling movement of the upper arm rotational joint means is formed as a traction mechanism or pressurizing gear.

12. The therapy and training device according to claim 1, wherein the base body has a connecting means for connection with a seat frame.

13. The therapy and training device according to claim 1, wherein the trunk body is provided with a seat frame.

14. The therapy and training device according to claim 13, wherein the seat frame is arranged to be folded down on the trunk body.

15. A therapy and training device comprising:

a trunk body with a rotational joint base;

two shoulder extensions coupled rotationally by a shoulder rotational joint means;

arm extensions on said shoulder extensions spaced apart from said rotational joint base; and an upper arm rotational joint means, said arm extensions being connected with said shoulder extensions around a transverse axis by said upper arm rotational joint means, said arm extensions being coupled in movement such that a rotational movement of one said arm extension causes a corresponding rotational movement of the other said arm extension, and wherein said rotational joint means is formed as a rotational shoulder joint such that said shoulder extensions are rotational about a vertical axis of said rotational shoulder joint and coupled in movement such that a rotational movement of one said shoulder extension causes a corresponding rotational movement of the other said shoulder extension.

16. A therapy and training device comprising:

a trunk body, two shoulder extensions mounted to said trunk body by linked shoulder joints, wherein a movement in one said shoulder extension causes a corresponding movement in the other said shoulder extension through said linking of said shoulder joints;

two upper arm extensions mounted to said shoulder extensions by linked upper arm joints, wherein a movement in one said upper arm extension causes a corresponding movement in the other said upper arm extension through said linking of said upper arm joints; and two lower arm extensions mounted to said upper arm extensions by linked lower arm joints, wherein a movement in one said lower arm extension causes a corresponding movement in the other said lower arm extension through said linking of said lower arm joints.

17. A therapy and training device according to claim 15 wherein, said trunk body has a positioning means for positioning the therapy and training device relative to the spinal column of a patient.

18. A therapy and training device according to claim 16 wherein, said trunk body has a positioning means for positioning the therapy and training device relative to the spinal column of a patient.

19. A therapy and training device according to claim 15 wherein, said trunk body has a neck receptacle adjustable relative to said trunk body.

20. A therapy and training device according to claim 16 wherein, said trunk body has a neck receptacle adjustable relative to said trunk body.

21. A therapy and training device according to claim 15 further comprising:

arm connections for connection of said arm extensions to arms of a patient.

22. A therapy and training device according to claim 16 further comprising:

lower arm connections for connection of said lower arm extensions to lower arms of a patient.

23. A therapy and training device according to claim 16 further comprising:

a seat on said trunk body.

* * * * *